US007137485B2

(12) United States Patent
Bärneman et al.

(10) Patent No.: US 7,137,485 B2
(45) Date of Patent: Nov. 21, 2006

(54) PROCEDURE AND APPARATUS FOR THE INSTALLATION OF AN ELEVATOR

(75) Inventors: Håkan Bärneman, Solna (SE); Gert Van Der Meijden, Otterlo (NL)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/166,185

(22) Filed: Jun. 11, 2002

(65) Prior Publication Data

US 2002/0148689 A1 Oct. 17, 2002

Related U.S. Application Data

(62) Division of application No. 09/180,355, filed as application No. PCT/FI98/00205 on Mar. 6, 1998, now Pat. No. 6,422,352.

(30) Foreign Application Priority Data

Mar. 7, 1997 (FI) ..... 970970

(51) Int. Cl.
*B66B 7/02* (2006.01)
*B66B 11/02* (2006.01)

(52) U.S. Cl. ..... 187/408; 187/406; 187/407; 187/900; 187/401

(58) Field of Classification Search ..... 187/408, 187/401, 411, 900; 52/30, 741.1, 745.02, 52/745.1, 745.2
See application file for complete search history.

(56) References Cited

U.S. PATENT DOCUMENTS 3,601,938 A 8/1971 Loomis
3,759,349 A 9/1973 Sieffert
3,851,736 A 12/1974 Westlake et al.
4,593,794 A * 6/1986 Russeau ..... 52/745.2
4,819,403 A * 4/1989 Penicaut et al. ..... 52/745.15
5,014,822 A 5/1991 Chapelain et al.
5,065,843 A 11/1991 Richards
5,230,404 A * 7/1993 Klein ..... 187/414
6,138,797 A * 10/2000 Pettersson et al. ..... 187/286

(Continued)

FOREIGN PATENT DOCUMENTS

GB 2194984 3/1988

(Continued)

OTHER PUBLICATIONS

Nakhov B.S. Skripka, B.F., "Montazh, naladka I ekspluatasiya liftov," Izdatelstvo literatury po stroitelstvu, Moscow, 1973, pp. 146, lines 1-6; with English translation.

*Primary Examiner*—Kathy Matecki
*Assistant Examiner*—Eric E. Pico
(74) *Attorney, Agent, or Firm*—Birch, Stewart, Kolasch & Birch, LLP.

(57) ABSTRACT

A procedure and an apparatus for plumbing and installing the shaft equipment for an elevator uses a plumbing jig. The plumbing jig is mounted in the upper part of the elevator shaft from the top floor, plumb lines are attached to the plumbing jig from the top floor and, using the plumb lines attached to the plumbing jig, the shaft equipment is positioned, whereupon the shaft equipment is fixed in place. The apparatus includes supporting elements that can be fixed to the elevator shaft, a plumbing jig that can be attached to the supporting elements and mounted substantially from the top floor, and plumb lines that can be suspended from the plumbing jig and extend into the elevator shaft below the plumbing jig.

14 Claims, 4 Drawing Sheets

U.S. PATENT DOCUMENTS 6,357,556 B1 * 3/2002 Pettersson et al. ..... 187/414
6,422,352 B1 * 7/2002 Pettersson et al. ..... 187/408

FOREIGN PATENT DOCUMENTS

JP 53023447 A * 3/1978
JP 54-138258 10/1979
JP 5-139657 6/1993
JP 5186160 7/1993
JP 5-319729 12/1993
JP 6009173 1/1994
JP 06009173 A * 1/1994
JP 6247661 9/1994
JP 06247661 A * 9/1994
JP 8-133623 5/1996

* cited by examiner

PROCEDURE AND APPARATUS FOR THE INSTALLATION OF AN ELEVATOR

This application is a divisional of application Ser. No. 09/180,355, filed on Jan. 6, 1999 now U.S. Pat. No. 6,422, 352 and for which priority is claimed under 35 U.S.C. § 120. application Ser. No. 09/180,355 is the national phase of PCT International Application No. PCT/FI98/00205 filed on Mar. 6, 1998 under 35 U.S.C. § 371. The entire contents of each of the above-identified applications are hereby incorporated by reference. This application also claims priority of Application No. 970970 filed in Finland on Mar. 7, 1997 under 35 U.S.C. § 119.

FIELD OF THE INVENTION

The present invention relates to a procedure and to an apparatus for use in the installation of an elevator.

DESCRIPTION OF THE BACKGROUND ART

For trouble-free operation of an elevator, it is necessary that the elevator should run along a vertical line. The elevator is normally installed in an elevator shaft built from concrete. The guide rails for the elevator car and counterweight are fixed to the shaft walls using rail fixtures. During the installation of the elevator, the guide rails and other shaft equipment are adjusted to their proper positions. In this context, shaft equipment refers to guide rails, landing doors and their mounting brackets. In the vertical direction, the alignment is effected using plumb lines, which are fixed at a point above the shaft equipment to be installed in the elevator shaft and which extend through the whole length of the shaft. It has also been suggested that the alignment could be done using a laser beam, but this method has not gained ground due to the costs and the difficult conditions at the site of the installation.

In prior art, the plumb lines are fixed to the floor of a machine room above the shaft and so positioned that they can be used to align the shaft equipment, such as guide rails, and the landing doors. The ceiling of the elevator shaft must be provided with holes for the plumb lines.

SUMMARY OF THE INVENTION

The object of the present invention is to develop a new solution for plumbing the shaft equipment in an elevator shaft to their proper positions, a solution that does not require any communication with a space above the shaft and that can be implemented without working above the finished building. To achieve this, the procedure of the invention involves the steps of mounting a plumbing jig in the elevator shaft, the step of mounting being carried out from the top floor and the plumbing jig being below the top of the elevator shaft; attaching plumb lines from the plumbing jig, the plumb lines being attached from the top floor, positioning various pieces of shaft equipment using the plumb lines attached to the plumbing jig; and fixing the various pieces in place after the step of positioning. The apparatus of the invention comprises support elements fixable to the elevator shaft, a plumbing jig attachable to the support elements and mountable substantially from the top floor, plumb lines suspendable from the plumbing jig and, when suspended from the plumbing jig, the plumb lines extend into the elevator shaft below the plumbing jig and are used to align at least one guide rail.

When the solution of the invention is used, all the operations required in elevator installation can be carried out from the elevator shaft or from a landing. When trimming the plumbing jig, the installers can work from a landing, so no scaffolding or temporary erecting stages are needed. The job can be performed substantially faster than before, when it was necessary to build a scaffolding for work in the elevator shaft or when the work was done from the roof and a passage to the roof had to be provided in addition to a separate connection between the elevator shaft and the space above the shaft. Now, there is no need for elevator installers to go to the roof at any stage, so this allows a clear distinction to be made between elevator installation and other construction work. In the case of an elevator without machine room, the installers can directly communicate with each other through-out the installation process.

By using the solution of the invention, the plumbing of all shaft equipment, guide rails and landing door mounting brackets can be effected with four plumb lines when a gauge is used to position the guide rails for the counterweight. This also contributes towards faster installation and, by using a suitable gauge, the guide rails can be installed so that their guide surfaces will be in correct positions relative to each other.

A frame used for the plumbing, i.e. a plumbing jig, fixed the positions of shaft equipment at their proper locations in the vertical direction. When the plumbing jig is moved horizontally during fine adjustment at the final plumbing stage, the various pieces of shaft equipment of the elevator remain in correct positions relative to each other. Thus, if the position of one of the plumb lines has to be readjusted, this can be done without separately readjusting the other plumb lines.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail the aid of some of its preferred embodiments by referring to the attached drawings, which are given by way of illustration only, and thus are not limitative of the present invention, and in which.

DETAILED DESCRIPTION OF THE PREFERRED EMBODIMENTS

Figure 1:
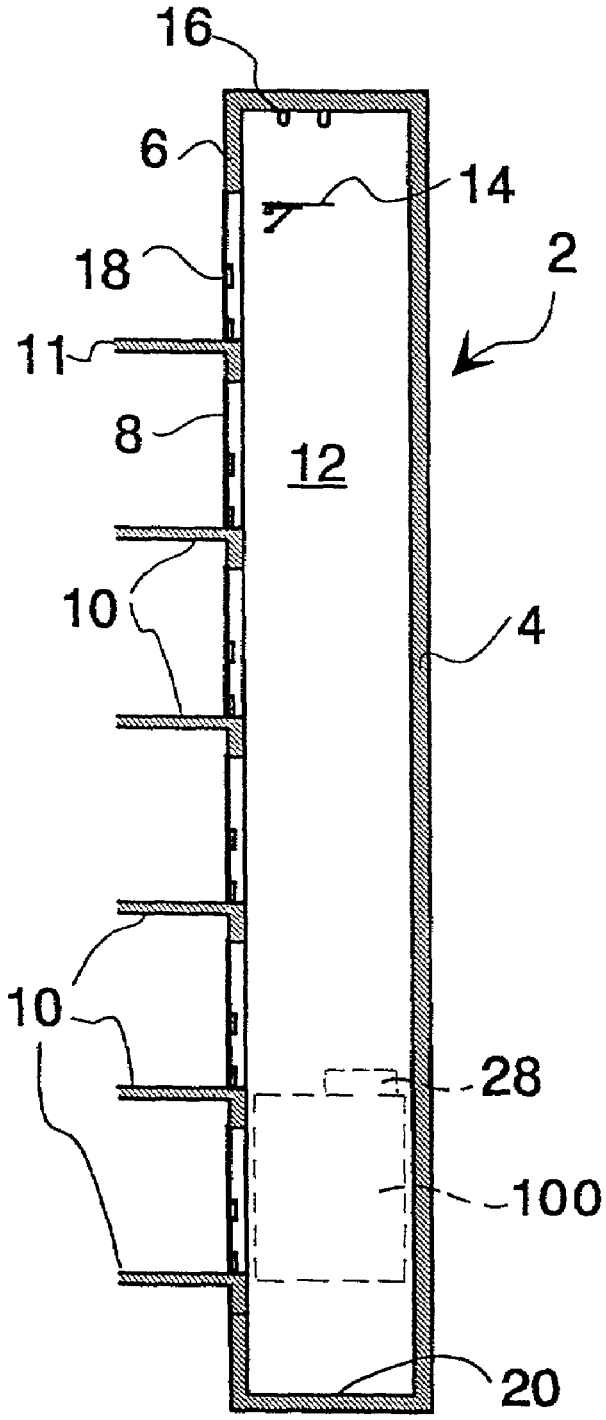
FIG. 1 presents an elevator shaft in lateral view.

FIG. 1 presents a cross-section of an elevator shaft 2 in side view. The shaft comprises a back wall 4 and a front wall 6, the latter being provided with door openings 8 at the landings 10 and 11, and side walls 12. The shaft extends somewhat below the lowest floor, forming a pit 20 in which the shaft equipment needed below the elevator car is installed.

At the top, the shaft is delimited by the ceiling 16 of the shaft. The door openings are provided with temporary safety walls 18, which may consist of e.g. plastic plates, wooden beams or steel bars. According to a first alternative embodiment of the invention, the shaft is provided with supporting elements 14 fixed to the side walls of the shaft above the top floor 11, on which elements the plumbing jigs 22 can be mounted as described below in detail.

Figure 2:
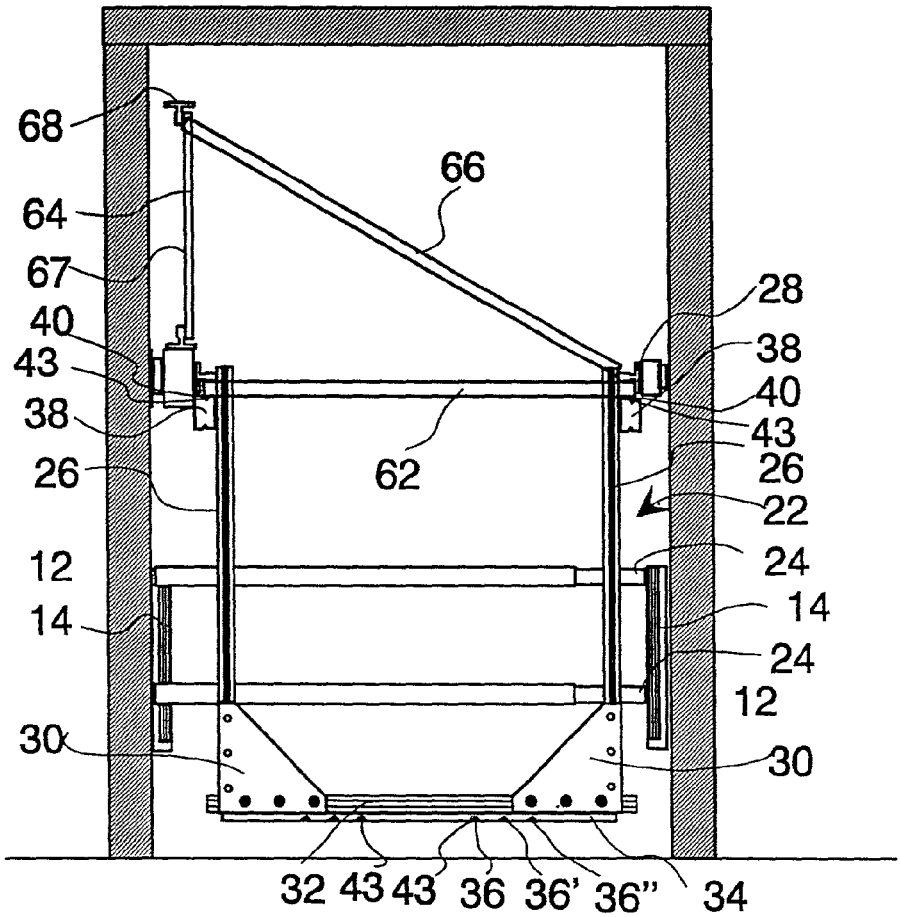
FIG. 2 presents a plumbing jig in top view.

The plumbing jig 22 (FIG. 2) is mounted using telescopic tubes 24 placed on the supporting elements 14, the tubes being adjusted to a length corresponding to the shaft width. The telescopic tubes 24 are attached to profiled bars comprised in the supporting elements 14. When the supporting elements 14 and the tubes 22 are mounted, their straightness is verified by means of a spirit level. The plumbing jig consists of two side bars 26 which, in the depth direction of the shaft, extend from the shaft door toward the back wall of the shaft to the plane of the guide rails 28. Fixed to the door-side ends of the side bars 26 are square elbows 30, which are further attached to a front bar 32 connecting the square elbows 30 to each other. The square elbows are adjustably attached to the side bars and the front bar, allowing the same mounting jig to be used in elevator shafts of different dimensions. Attached to the front bar is a plumbing plate 34, which is provided with notches 36 located at the positions where the plumb lines for the landing door mounting brackets are to be set. Notches 36' and 36" are for different elevators. Attached to the shaft-guide ends of the side bars are plumbing plates 38 for the guide rails of the elevator car, the plates being provided with notches 40 for the plumb lines 43 used to plumb the guide rails 28. The attachment of the plumbing plates 38 to the side bars 26 can be adjusted according to the dimensions of the elevator shaft. Once the plumbing jig has been assembled according to the dimensions of the elevator to be installed, their mutual positions will remain unchanged. Turning or rotating the plumbing jig horizontally causes a corresponding change in the positions of all the pieces of equipment to be installed.

To carry out the plumbing, a plumbing jig is assembly corresponding to the configuration of the elevator shaft is set up. The plumb lines are dropped into the shaft and fixed to the positions marked on the plumbing plates. On the shaft bottom, the positions of the guide rail lines are measured correspondingly and the plumb lines are fixed in place. At each floor, the plumb lines and the corresponding positions of guide rails and landing door mounting brackets are checked. If necessary, the plumb line positions are readjusted to bring the entire shaft into alignment. Installation of the elevator guide rails is started from the lowest guide rail, proceeding one guide rail pair at a time up to the top. The positions of the counterweight guide rails are determined by means of a special gauge, which is used to ensure that the guide rails are installed in a straight vertical line and also that the guide rail guide surfaces are perpendicular and in alignment with the guide surfaces of other guide rails. The gauge comprises a bar 62 placed between the guide rails in the shaft and provided with aligning points for a plumb line 43, and a rod 64 between the counterweight guide rails 67 and 68 and a rod 66 between one. 68 of the counterweight guide rails and one 28 of the car guide rails.

Figure 3:
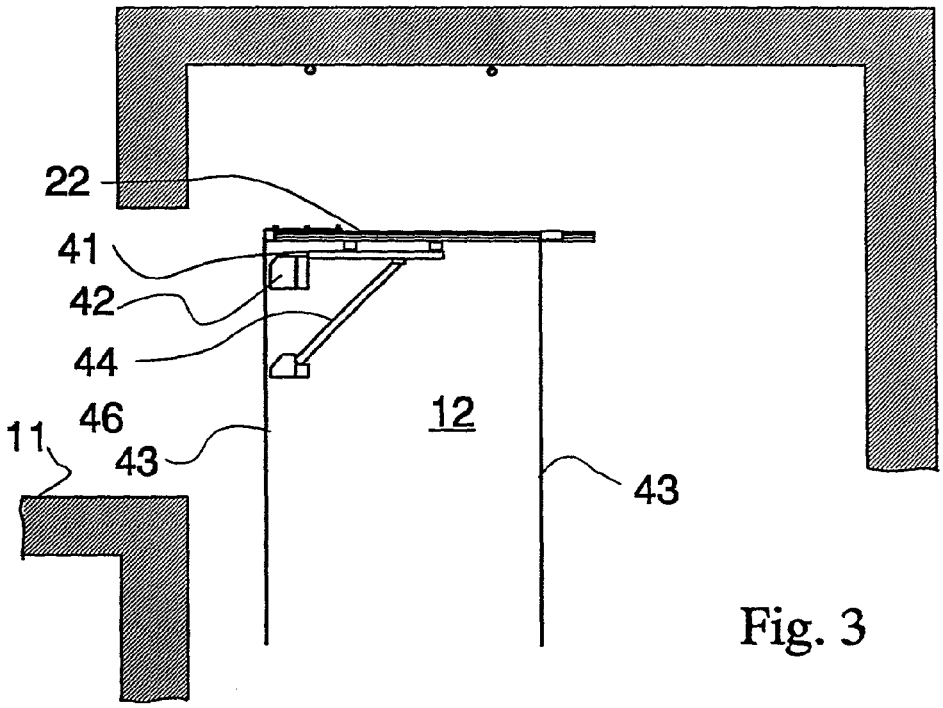
FIG. 3 presents an arrangement according to the invention in lateral view.
Figure 4:
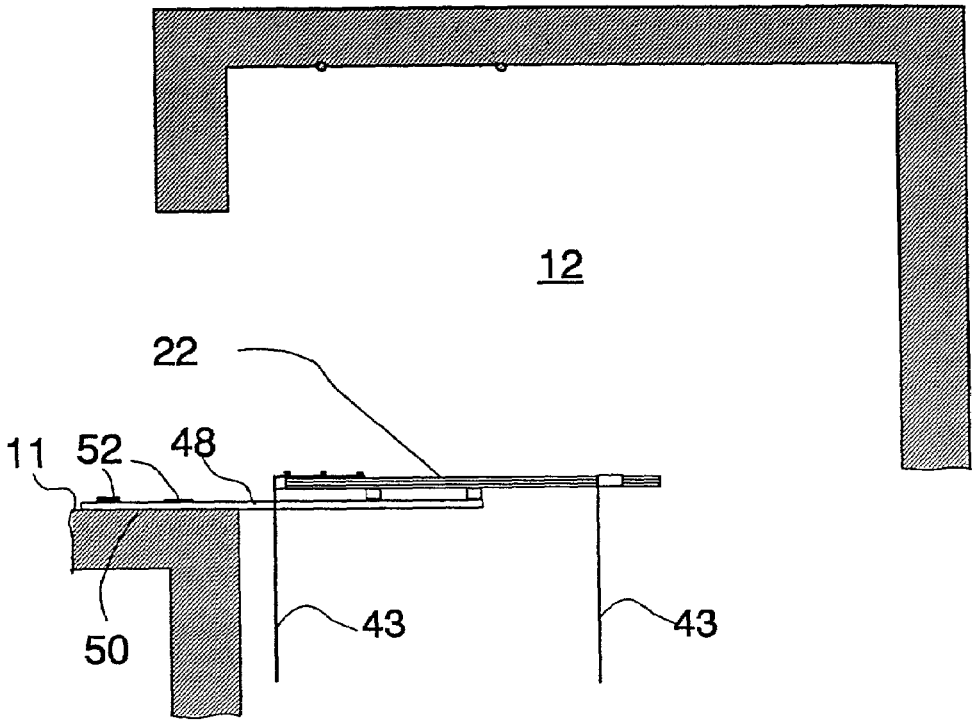
FIG. 4 presents another arrangement according to the invention in lateral view.
Figure 5:
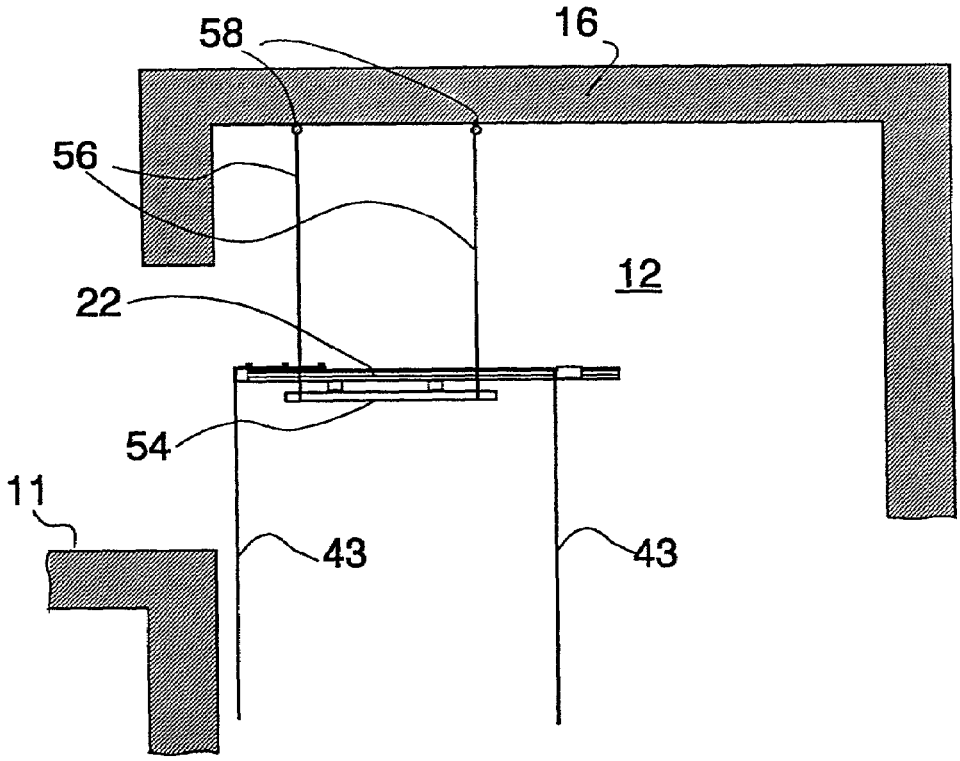
FIG. 5 presents a third arrangement according to the invention in lateral view.

FIGS. 3, 4 and 5 illustrate different arrangements for mounting the supporting elements for the plumbing jig in the elevator shaft. In FIG. 3, a supporting element has been fixed to a shaft wall. The supporting element consists of a horizontal bar 41 whose one end is fastened to an adapter plate 42 bolted to the wall while the other end rests on an oblique supporting bar 44. The supporting bar is attached by its lowers end to another adapter plate 46. When the supporting element is being mounted, the adapter plates are used to adjust the supporting element so as to bring it into a horizontal position and into alignment with another supporting element mounted on the opposite shaft wall. The adapter plates are placed on the shaft wall adjoining the landing, so he supporting elements are easily accessible and adjustable during installation. The supporting element is preferably mounted above the top floor so that it is at a suitable height for installers working on the floor and that the fixtures for all guide rails can be easily positioned by means of the plumb lines 43. The plumbing jig 22 is placed on and attached to the supporting elements.

In the embodiment illustrated by FIG. 4, the supporting element 48 is mounted on the top floor 11, being fixed to the landing floor 50 e.g. by means of bolts 52. Alternatively, the supporting element may be fixed to other landing structures. The plumbing jig 22 itself may be implemented as described above.

In a further embodiment (FIG. 5) of the invention, the supporting elements for the plumbing jig are formed from two bars 54 suspended from the ceiling 16 of the elevator shaft. The bars 54 are fixed to wire cables or bars 56 whose other ends are fixed to hooks 58 mounted in the shaft ceiling. The vertical position of the supporting elements is adjusted e.g. by means of an adjusting screw fitted at the lower end of bar 56. In this case, the supporting element is preferably placed at a suitable working height relative to the top floor. The plumbing jig 22 may be implemented as described above.

Figure 6:
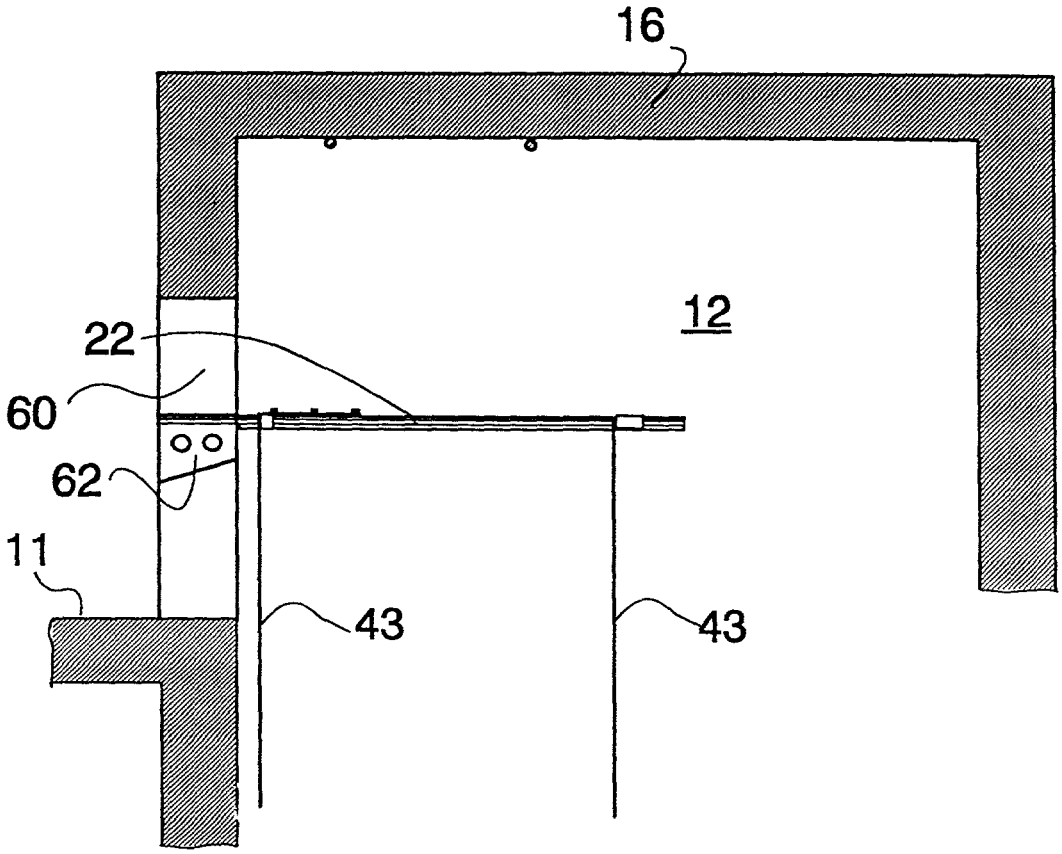
FIG. 6 presents a fourth arrangement according to the invention in lateral view.
Figure 7:
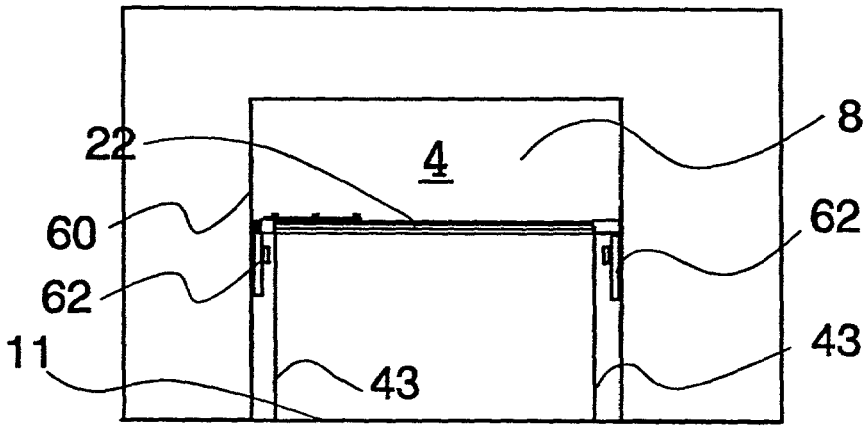
FIG. 7 presents a fourth arrangement according to the invention viewed from the top floor.

In the fourth embodiment to install the plumbing jig (FIG. 6 and FIG. 7) there are mounting brackets 62, which are fixed the door jambs 60 on the top floor 11. The brackets may also be fixed to the side walls if there is no front wall or they may be fixed to the edges of the front wall on the both sides of the door openings 8. According to this embodiment the plumbing jig 22 can be fixed easily and the mounter does not need to stretch himself to the shaft when fixing the plumbing jig.

To install shaft equipment 28, the shaft equipment is lifted from the bottom of the shaft 20 using the elevator car 100.

In the foregoing, the invention has been described by the aid of one of its embodiments.

However, the presentation is not to be regarded as constituting a restriction of the sphere of patent protection, but the embodiments of the invention may be varied within the limits defined by the following claims.

The invention claimed is:

1. An elevator and apparatus for plumbing and installation of shaft equipment for the elevator, the apparatus being positionable in an elevator shaft of the elevator, the elevator shaft having a top and a bottom, the top of the elevator shaft being adjacent to a top floor, the apparatus comprising:

support elements fixable to or adjacent to the elevator shaft;

a plumbing jig attachable to the support elements and mountable from the top floor, the plumbing jig is located in the elevator shaft below the top of the shaft and between a top and bottom of a shaft door opening on the top floor, the plumbing jig when mounted in the shaft being readily accessible from the top floor by an installer;

plumb lines suspendable from the plumbing jig and, when suspended from the plumbing jig, the plumb lines extend into the elevator shaft below the plumbing jig and are used to align at least one guide rail.

2. The apparatus as defined in claim 1, wherein the elevator shaft has shaft walls, a floor, and a ceiling and wherein the support elements are fixable to at least one of the shaft walls, the floor, the shaft ceiling and the door jambs.

3. The apparatus as defined in claim 1, wherein die top floor has a top floor door with jambs and wherein the support elements are fixable on the jambs of the top floor door.

4. The apparatus as defined in claim 1, wherein the top floor has a top floor door and wherein the support elements are fixable on a front wall of the top floor door.

5. The apparatus as defined in claim 1, wherein four plumb lines are provided as the plumb lines and wherein the apparatus further comprises a gauge.

6. The apparatus as defined in claim 1, wherein the support elements are suspended from a ceiling of the elevator shaft.

7. The apparatus as defined in claim 6, wherein the support elements are out of contact with walls of the elevator shaft.

8. The apparatus as defined in claim 1, further comprising wire cables fixed to a ceiling of the elevator shaft, the support elements being suspended from the wire cables.

9. The apparatus as defined in claim 1, wherein the top floor has a landing and wherein the support elements are fixed to the landing of the top floor.

10. The apparatus as defined in claim 1, wherein the elevator shall has at least one wall and wherein the plumbing jig is mounted on the support elements which are attached to the at least one wall of the elevator shaft.

11. The apparatus as defined in claim 1, wherein the top floor has a top floor door with jambs and wherein the plumbing jig is mounted on the jambs of the top floor door.

12. The apparatus as defined in claim 1, wherein the top floor has a top floor door and wherein the plumbing jig is mounted on a front wall of the top floor door.

13. The apparatus as defined in claim 1, further comprising means for installing the shaft equipment, the means for installing including an elevator car which is in the shaft, the shaft equipment being lifted in the shaft by the elevator car.

14. The apparatus as defined in claim 1, wherein the plumbing jig is mountable on the support element and the plumb lines are suspended from the plumbing jig without using scaffolds or ladders.

* * * * *